US006642948B2

(12) United States Patent
Miki

(10) Patent No.: US 6,642,948 B2
(45) Date of Patent: Nov. 4, 2003

(54) THERMAL TRANSFER PRINTING METHOD AND PRINTER SYSTEM

(75) Inventor: Takeo Miki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/193,166

(22) Filed: Jul. 12, 2002

(65) Prior Publication Data

US 2003/0035045 A1 Feb. 20, 2003

(30) Foreign Application Priority Data

Aug. 17, 2001 (JP) ..... 2001-248096

(51) Int. Cl.[7] ..... B41J 2/325
(52) U.S. Cl. ..... 347/213
(58) Field of Search ..... 347/171, 172, 347/174, 176, 213, 217, 182, 197; 400/120.01, 120.02, 120.04, 120.06, 120.16

(56) References Cited

U.S. PATENT DOCUMENTS 4,780,729 A 10/1988 Murakami et al.
4,952,085 A * 8/1990 Rein ..... 347/182
6,243,121 B1 6/2001 Agano

FOREIGN PATENT DOCUMENTS

| | | |
|---|---|---|
| DE | 195 19 956 | 12/1996 |
| EP | 0 280 241 | 8/1988 |
| JP | 6-59739 | 8/1994 |
| JP | 63-120667 | 8/1994 |
| JP | 2000-135810 | 5/2000 |
| JP | 2000-225774 | 8/2000 |
| JP | 2002-79765 | 3/2002 |

* cited by examiner

*Primary Examiner*—Huan Tran
(74) *Attorney, Agent, or Firm*—Pillsbury Winthrop LLP

(57) ABSTRACT

A thermal transfer printing method conducts a thermal transfer printing by alternately driving heating elements of a thermal print head using a multi-colored thermal transfer ink ribbon, an intermediate transfer medium, the thermal print head and a platen roller that press fits these components. Thickness of ink layers of the thermal transfer ink ribbon is 0.4–1 $\mu$m and the rubber hardness of the platen roller is 80° or more.

15 Claims, 11 Drawing Sheets

THERMAL TRANSFER PRINTING METHOD AND PRINTER SYSTEM

CROSS-REFERENCE TO RELATED APPLICATIONS

This application is based upon and claims the benefit of priority from the prior Japanese Patent Application No. 2001-248096, filed on Aug. 17, 2001: the entire contents of which are incorporated herein by reference.

BACKGROUND OF THE INVENTION

This invention relates to a thermal transfer printing method and a printer system for printing face images for recognizing individuals and character images such as individual information on recording media.

So far, a sublimation dye transfer printing method is available as a main stream of methods for printing face images on image display media containing face images for recognizing individuals such as, for example, driver's licenses, passports, credit cards, membership cards and so forth. This sublimation dye transfer printing method is to make the sublimation transfer printing of desired images on printing media by superimposing a thermal transfer ribbon having sublimation (or heat migration) dyes coated on a film-shaped support member on a printing medium having a receptor layers capable of receiving sublimation dyes, and heating the thermal transfer ribbon selectively according to image data.

It is widely well known that a highly gradient color image can be printed easily according to this sublimation dye transfer printing method. However, sublimation materials that are usable for dying by the sublimation dye are limited. Therefore, this method has such a defect that the method is applicable only to limited printing media. Further, sublimation dyes are generally inferior in such image durability as light fastness, solvent resistance, etc. Further, ultraviolet rays exciting type fluorescent dyes excellent in light fastness are not available, as sublimation dyes and therefore, forgery preventive measures must be provided separately.

On the other hand, a thermofusible transfer printing method is for printing a desired image on a printing medium by selectively heating thermal transfer ribbons coated with colored pigments or dyes dispersed in a binder such as resin or wax on a film-shaped support member and transferring colored pigments or dyes on printing media together with a binder.

According to this thermofusible transfer printing method, inorganic or organic pigments that are generally said to have a good light fatness are selectable for coloring materials. Further, resin and wax that are used as a binder are selectable and therefore, solvent resistance can be improved. Basically, any printing media is usable provided that it is adhesive to a binder and printing media in the wide range are selectable and this thermofusible transfer printing method has merits against the sublimation dye transfer printing method.

However, the thermofusible transfer printing method uses a dot area gradation method for the gradation printing by changing transferred dot sizes and therefore, various devises become necessary for multiple gradation printing by accurately controlling dot sizes. For example, there is a method to transfer dots by arranging them in zigzags (hereinafter, this method is referred to as an alternate driving method). When this alternate driving method is used, the heat interference between adjacent heating elements of the thermal print head can be reduced and it can be free from the influence of adjacent pixels. Accordingly, the satisfactory multiple gradation printing becomes possible as dot sizes are accurately controlled.

Further, in order to accurately control dot sizes, the surface of a printing medium must be in satisfactory state but the merit of the thermofusible transfer printing method that is able to select printing media in a wide range is impeded.

So, an indirect transfer printing method is devised to transfer a receptor layer of an intermediate transfer medium on a printing medium after printing multiple gradations on an intermediate transfer medium having a receptor layer of the satisfactory surface. According to this method, when an intermediate transfer medium is adjusted so that it can be transferred on a printing medium, it is not required to select a printing medium and therefore, the multiple gradations can be printed for any printing medium.

However, even for the methods described above, there are problems shown below.

For example, when an image resolution rises, it becomes necessary to control dots to more small sizes. However, a conventional ink ribbon having a more than 1 $\mu$m thick ink layer cannot follow a resolution more than 300 dpi and the image quality will be deteriorated.

When the thickness of ink layers of an ink ribbon is reduced to 1 $\mu$m or less, it becomes possible to follow a high resolution. However, a conventional thermal print head that forms one pixel by one heating element drives the heating elements alternately, there is such a problem that the central portion of a heating element rises to an excessively high temperature and the ink layers are broken and the image quality is deteriorated.

Further, when the tonal printing is made according to the thermal transfer printing method, especially, by the thermofusible transfer printing method, if the surface smoothness of the platen roller for press fitting the thermal print head, the ink ribbon and a printing medium is low, there is such a problem that the ink layers and the receptor layer of a printing medium are not satisfactorily for the uneven surface of the platen roller and the image quality is deteriorated.

When printing the multi-gradations, the heating elements should be driven alternately and when printing Binary images such as character images, it must be set so as to drive the heating elements similarly to the array of pixels. However, this setting was made by an image processor provided to a printer and there is such a problem that the image processor are complicated and a price becomes high.

Further, black ink for printing binary images such as character images and fluorescent ink for forgery prevention are prepared in the composition differing from color inks that are used for printing multi-gradation images such as face images. In the gray scale of black only and the multi-gradation printing of fluorescent image, the printing was made by an artificial gradation method such as dither or achieved by superimposing color inks. Therefore, there is such problems that the image quality is deteriorated and cost is increased as color ink consumption increase.

BRIEF SUMMARY OF THE INVENTION

It is an object of this invention to provide a thermal transfer printing method capable of printing multi-valued images like highly gradient color images, binary images like character images and fluorescent images that are capable of preventing forgery and alteration in high quality, and a printer system.

According to an embodiment of this invention, there are provided a thermal transfer printing method in a thermal transfer printing apparatus including: a thermal transfer ink ribbon having a 0.4–1 μm thick color thermofusible ink layers formed on a film-shaped substrate member; an intermediate transfer medium having a receptor layer on which ink in the multiple thermofusible color ink layers are transferred from the thermal transfer ink ribbon formed on a film-shaped substrate member; a thermal print head having multiple heating elements arranged in a line so as to form one pixel using at least two heating elements; and a platen roller formed by an elastic material having a rubber hardness more than 80° contacting the thermal print head, the thermal transfer ink ribbon and the intermediate transfer medium in the overlapped state, the thermal transfer printing method comprising: forming an image on the receptor layer of the intermediate transfer medium by selectively applying and driving the heating elements of the thermal print head according to image data so as to thermally transfer inks of thermofusible ink layers from the thermal transfer ink ribbon on the intermediate transfer medium; and transferring the receptor layer of the intermediate transfer medium having the formed image on a printing medium under pressure and heat.

Further, according to the embodiment of this invention, there are provided a printer system comprising: a printer including: a thermal transfer ink ribbon having a 0.4–1 μm thick color thermofusible ink layers formed on a film-shaped substrate member; an intermediate transfer medium having a receptor layer on which inks in the multiple thermofusible color ink layers are transferred from the thermal transfer ink ribbon formed on a film-shaped substrate member; a thermal print head having multiple heating elements arranged in a line so as to form one pixel using at least two heating elements; and a platen roller formed by an elastic material having a rubber hardness more than 80° contacting the thermal print head, the thermal transfer ink ribbon and the intermediate transfer medium in the overlapped state, and a print controller to control the image printing by selectively powering and driving the heating elements of the thermal print head according to image data, form an image on the receptor layer of the intermediate transfer medium by thermally transferring inks of the thermofusible ink layers of the thermal transfer ink ribbon on the receptor layer of the intermediate transfer medium, and transfer the receptor layer of the intermediate transfer medium with the image formed thereon; and a computer connected to the printer via a two-way communication means and send image data to be printed to the print controller of the printer.

BRIEF DESCRIPTION OF THE DRAWINGS

FIG. 7A is a plan view and FIG. 7B is a vertical sectional side view;

DETAILED DESCRIPTION OF THE INVENTION

A preferred embodiment of this invention will be explained below referring to the attached drawings.

First, the alternate driving of the heating element of the thermal print head involved in this embodiment; in detail, a method for printing by arranging dots in zigzags will be explained.

Figure 1:
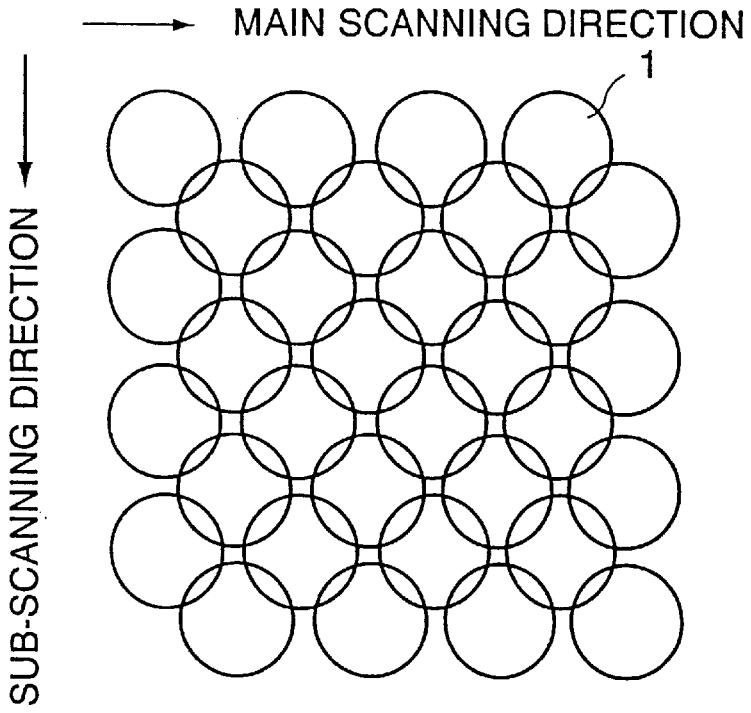
FIG. 1 is a diagram showing an example of dot arrangement when a heating element in a thermal print head is driven alternately.

The alternate driving of the heating elements of the thermal print head is a method to drive the odd-numbered heating elements of the odd-numbered lines and the even-numbered heating elements of the even-numbered lines for each printing line. When the heating elements are driven in this way, the printed dots are arranged in zigzags and form an image as shown in FIG. 1. Here, the main scanning direction is the direction in which the heating elements of the thermal print head are arranged, and the sub-scanning direction is the direction that is orthogonal to the main scanning direction.

Figures 2A, 2B:
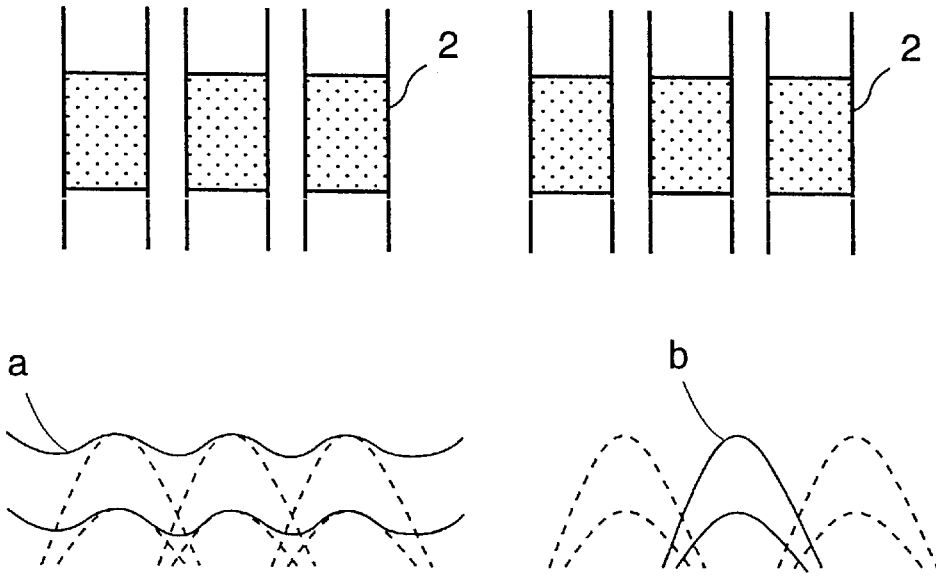
FIG. 2A and FIG. 2B are schematic diagrams showing the heating element of the thermal print head and the temperature distribution in an ink layer.

FIG. 2 shows the heating elements of the thermal print head and the temperature distribution in the ink layer of the thermal transfer ink ribbon. Reference Numeral 2 in the figure shows the heating elements of the thermal print head. When the entire heating elements 2 are driven simultaneously for printing an image instead of driving the heating elements alternately, heat interference is generated because of a narrow distance between the adjoining heating elements 2 and the temperature distribution is in the flat state as shown in FIG. 2A (the solid line a in the figure). That is, there is no temperature contrast between the adjoining heating elements 2. Therefore, the dot sizes cannot be modulated accurately and it becomes difficult to make the multiple gradation printing.

On the other hand, in the case of the alternate driving without driving the adjoining heating elements 2 for every printing line, a distance between the heating elements 2 being driven is wide (in detail, a distance is 2 times the heating element arranging pitch) and heat escapes to the heating element 2 that is not being driven in the thermal print head as shown in FIG. 2B. Therefore, the heat interference is scarcely generated and the temperature distribution is in a steep shape (the solid line b in the figure). That is, the temperature is contrasted between the adjoining heating elements 2.

Thus, the alternate driving is able to surely form isolated dots. Further, the dot size can be surely demodulated without being affected by adjoining dots and the multiple gradient printing utilizing the area gradation is enabled.

Figure 3A:
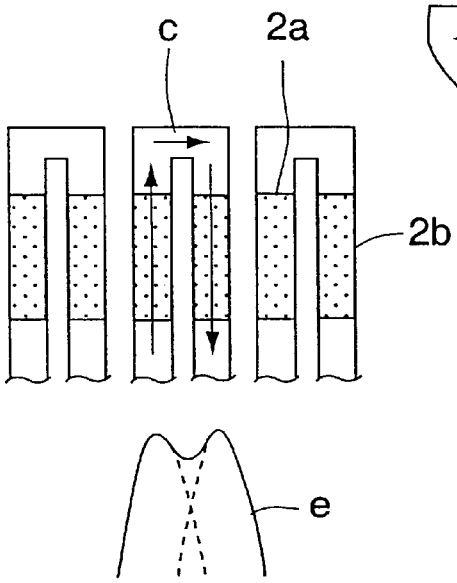
FIG. 3A and FIG. 3B are schematic diagram showing the rough structure of the heating element of the thermal print head involved in one embodiment of this invention and the corresponding temperature distribution in the ink layer.
Figure 3B:
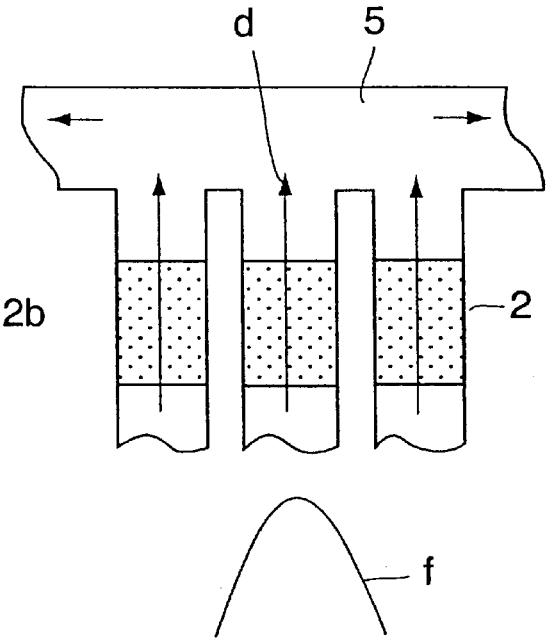
Figure 4A:
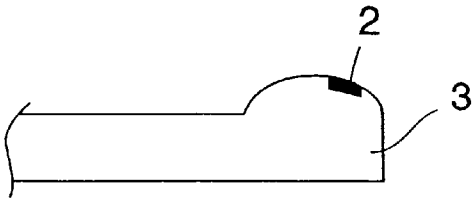
FIG. 4A and FIG. 4B are circuit diagrams of the thermal print head involved in one embodiment of this invention.
Figure 4B:
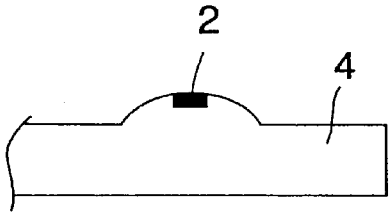
Figure 11:
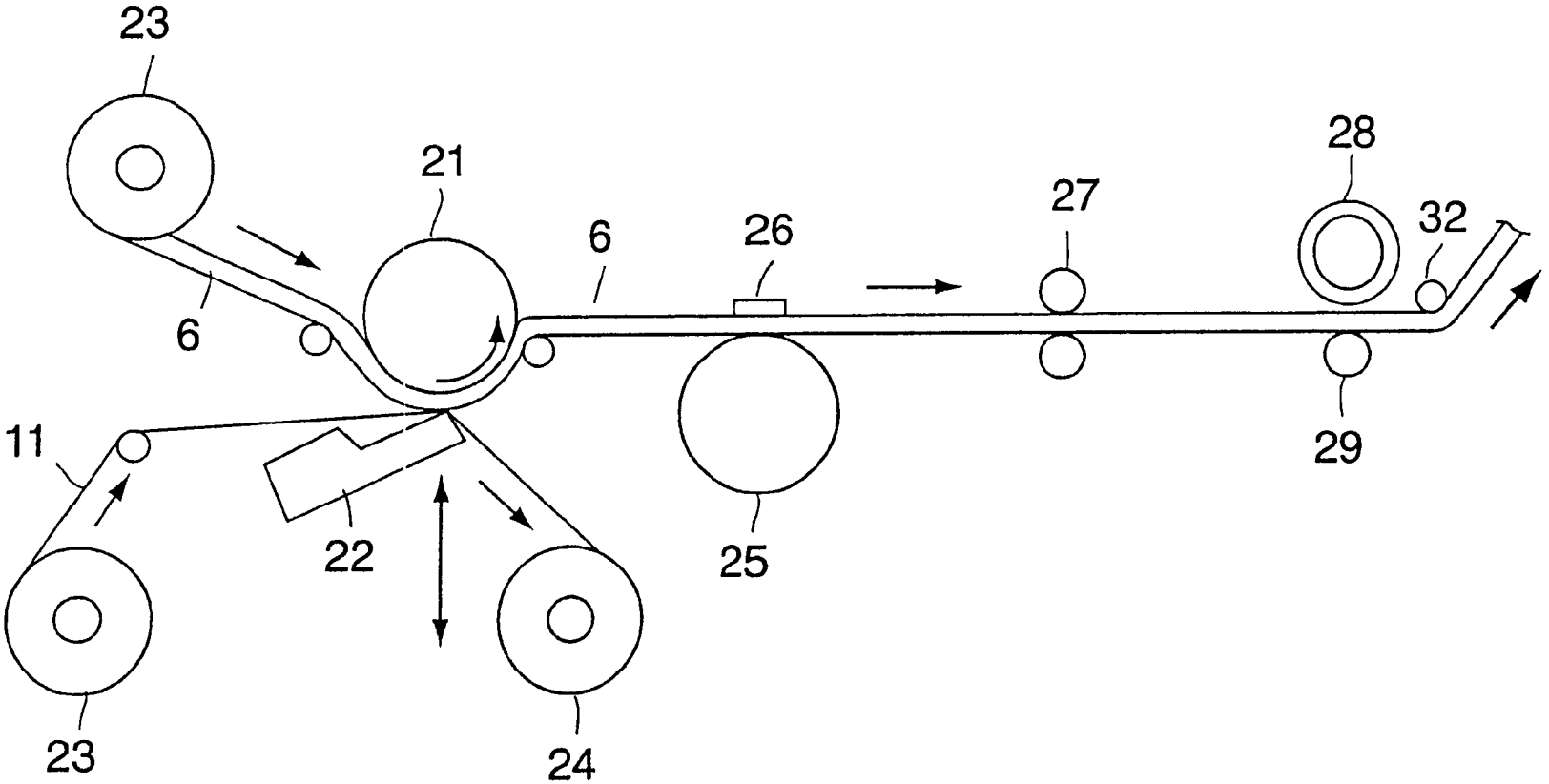
FIG. 11 is a schematic block diagram schematically showing the structure of the printer shown in FIG. 8.

FIGS. 3A and 3B show the rough structure of the thermal print head heating elements and the corresponding temperature distribution in the ink layers. FIGS. 4A and 4B show the rough structure of the thermal print head. In this embodiment, the thermal print head is an edge-type thermal print head 3 as shown in FIG. 4A, wherein the heating elements 2 are formed near the edge of the thermal print head 3. As the edge-type thermal print head 3 can be installed by inclining in the tangent direction of the pushing portion of the platen as shown in FIG. 11 that is shown later, printing media are easily supplied. Further, it has a merit in the down sizing of a system because a required space is less than a plane thermal print head.

Further, in the edge-type thermal print head 3 in this embodiment, one pixel is formed with two heating elements 2*a* and 2*b* in one set as shown in FIG. 3A. Current applied to heat the heating elements passes through two heating elements 2*a* and 2*b* in series and returns back to a power source through a driving circuit (not shown) as shown by an arrow c in FIG. 3*a*. That is, a current circuit is not common with heating elements of other sets except the wiring to the power source.

On the other hand, an normal plane type thermal print head 4 is in the structure to form one pixel by one heating element 2 as shown in FIG. 4B. Current applied to heat the heating element passes through the heating elements 2 and returns back to a power source via a common electrode 5 connected with all heating elements 2 as shown by an arrow d in FIG. 4B.

Figure 5A:
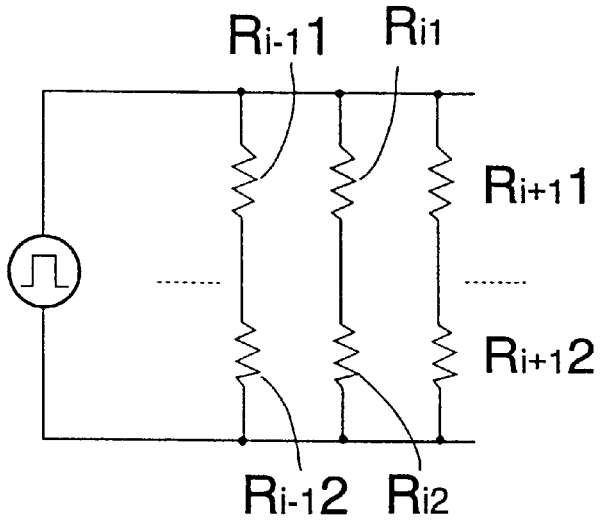
FIG. 5A and FIG. 5B are electrical equivalent circuits of a heating element of the thermal print head involved in one embodiment of this invention.
Figure 5B:
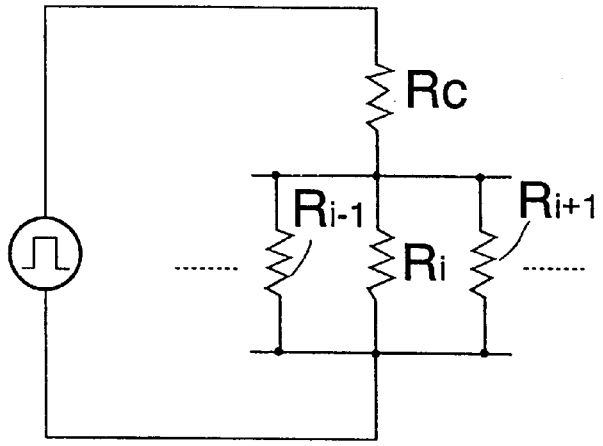

FIGS. 5A and 5B are electrical equivalent circuits expressed this flow of current. FIG. 5A is the circuit for the edge-type thermal print head 3 and FIG. 5B is the circuit for the plane-type thermal print head 4. Ri1 and Ri2 in FIG. 5A are electric resistances of the heating elements 2*a* and 2*b*. R1 in FIG. 5B shows electric resistance of the heating element 2 and Rc indicates electric resistance of the common electrode 5. The heating element 2 of the plane-type thermal print head 4 can be expressed as a parallel resistance group connected to the common electrode 5 in series as shown in FIG. 5B. As the resistance Rc is smaller than Ri, if the heating elements to be driven are less, the voltage drop can be ignored.

However, when the number of heating elements to be driven is increased, the values of entire heating elements which are the group of parallel resistors drop and therefore, voltage drop of the resistor Rc cannot be not ignored. So, voltage applied to the heating element drops and the heat value decreases. That is, the heat value changes according to the number of heating elements to be driven. On the other hand, in the edge-type thermal print head 3, voltage applied to the heating elements does not change according to the number of heating elements to be driven as there is no common electrode 5 as shown in FIG. 5A. Therefore, the edge-type thermal print head 3 does not require the control according to the number of heating elements to be driven like in the plane-type thermal print head 4 and it has a merit that the driving control is simplified.

Further, in the edge-type thermal print head 3, the heating elements 2*a* and 2*b* are made one set and the temperature distribution in the ink layers is high at the central portion of the heating elements and somewhat low between two heating elements 2*a* and 2*b* but the temperature at the central portion of pixels does not become high.

On the other hand, in the plane-type thermal print head 4, one heating element 2 is heated and the temperature distribution in the ink layer is high at the central portion of the heating element 1 as shown by f in FIG. 3B.

When driving the heating elements alternately, adjacent heating elements must be heated to a transfer temperature and therefore, the temperature at the centers of the heating elements was raised excessively and it was possible to break an ink ribbon. On the contrary, the edge-type thermal print head 3, wherein the high temperature portions are close to adjacent heating elements and the central portions of pixels do not rise to a high temperature has a merit not to break the ink ribbons even when the heating elements are drive alternately.

Next, an intermediate transfer medium and a thermal transfer ink ribbon involved in this embodiment will be explained.

Figure 6:
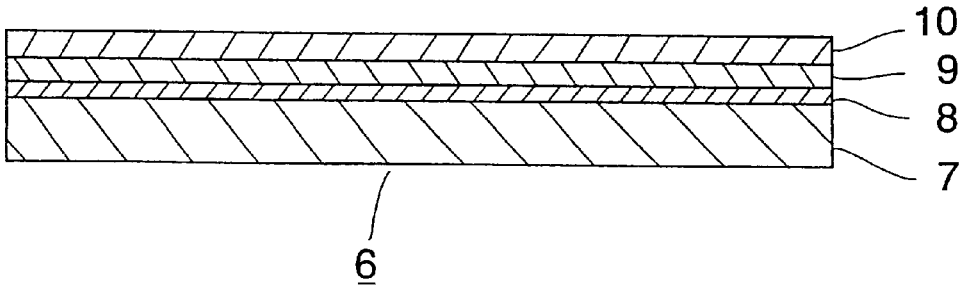
FIG. 6 is a vertical sectional side view schematically showing the structure of an intermediate transfer medium involved in one embodiment of this invention.

FIG. 6 schematically shows the structure of the intermediate transfer medium involved in this embodiment. The intermediate transfer medium 6 is formed on one surface of long film-shaped substrate member 7 by laminating a separatable layer 8 comprising a wax, a protective layer 9 comprising a resin 9 and a receptor layer 10 in this order. For the substrate member 7, film-shaped synthetic resins such as polyethylene terephthalate (hereinafter, simply referred to as PET) or polyethylene naphthalate (hereinafter, simply referred to as PEN). In this embodiment, a 25 $\mu$m thick PET was used.

The receptor 10 is demanded to be compatible with the ink layer of the ink ribbon that is described later and have a smooth receptor surface, and urethane resin, epoxy resin, acrylic resin, styrene resin or mixed resin of these resins are best suited. In this embodiment, a mixed resin mainly comprising urethane resin and epoxy resin was coated on the protective layer 9 in the 5$\mu$ thickness.

Here, the protective layer 9 is applied with a forgery or alteration preventing measure such as a hologram in many cases. In this embodiment, the protective layer 9 applied with the hologram was also used. The thickness of the protective layer 9 in this embodiment was 10 $\mu$m.

Figure 7A:
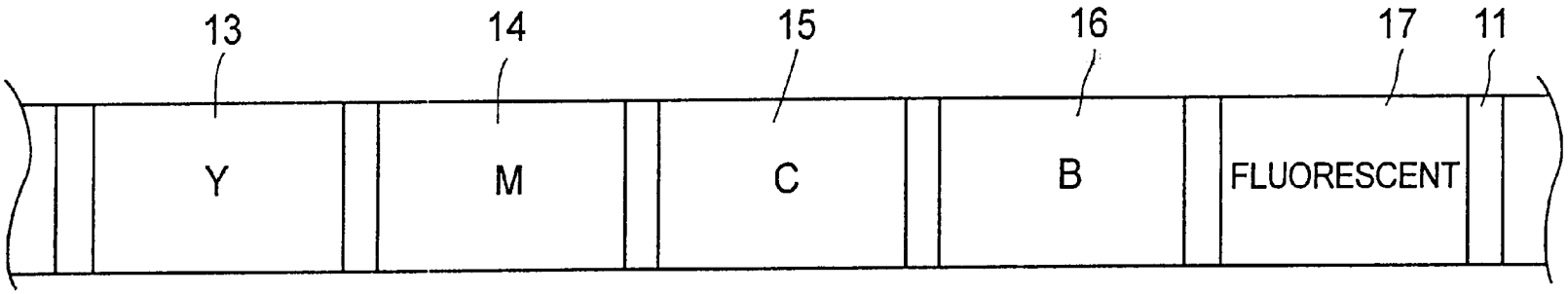
FIGS. 7A and 7B schematically show the structure of the thermal transfer ink ribbon involved in one embodiment of this invention.
Figure 7B:
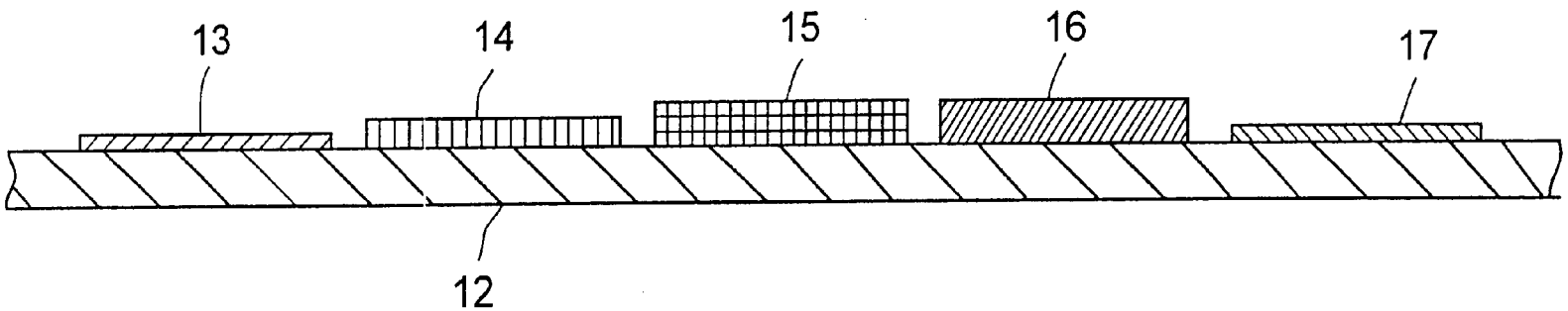

FIG. 7 schematically shows the structure of a thermal transfer ink ribbon involved in this embodiment. A thermal transfer ink ribbon 11 comprises an yellow ink layer 13, a magenta ink layer 14, a cyan ink layer 15, a black ink layer 16, and a fluorescent ink layer 17. These ink layers are thermofusible multiple color ink layers arranged in a line on a long film-shaped support member 12 in the order shown above. Here, the ink layers 13–17 are not necessarily arranged in the order described above but they can be arranged in the order that is decided according to the transparency of the ink layer. The fluorescent ink layer 17 is in the structure where a fluorescent pigment or dye that becomes visibly luminous when ultra-violet rays are applied is dispersed in a binder.

The support member 12 is a 2–6 $\mu$m thick synthetic resin film, for example, a PET. In this embodiment, a 4.5 $\mu$m thick PET was used. The ink layers 13–17 have inorganic and organic pigments and fine grains dispersed in the resin made binders.

For the binder, thermofusible, colorless transparent or light color transparent resins having a melting point about 60 to 100° C., for example, a vinyl acetate-vinyl chloride copolymer, a vinyl acetate-ethylene copolymer, saturate polyester resin, epoxy resin, acrylic resin or styrene resin are suitably used. In this embodiment, for compatibility with the intermediate transfer medium 6, the binder comprising saturated polyester resin as a main component was used. Further, fine particles are dispersion agents of pigments. Silica was used in this embodiment.

Further, in this embodiment, desired colors are expressed in color ink dots by placing one upon another in order and therefore, if an ink layer transferred preceding was thick, the transferred dots were strongly affected by the uneven state of dots and defective transfer or broken dots could be produced. So, the ink layers 13–17 are desired thin as could as possible.

In addition, in order for expressing highlight, it is necessary to reproduce small size dots as could as possible. To reproduce small size dots, the thin ink layers are desirable. As described later, a desirable thickness of the ink layers 13–17 is 0.4 to 1 $\mu$m. In this embodiment, the thickness of the ink layers was made at 0.4 $\mu$m. Although the ink layer thickness of respective colors was changed from the relation with the superposing order and printing density of ink dots, all ink layers were adjusted to the thickness falling in the range of 0.4 to 1 $\mu$m.

Next, a printer system involved in this embodiment will be explained.

Figure 8:
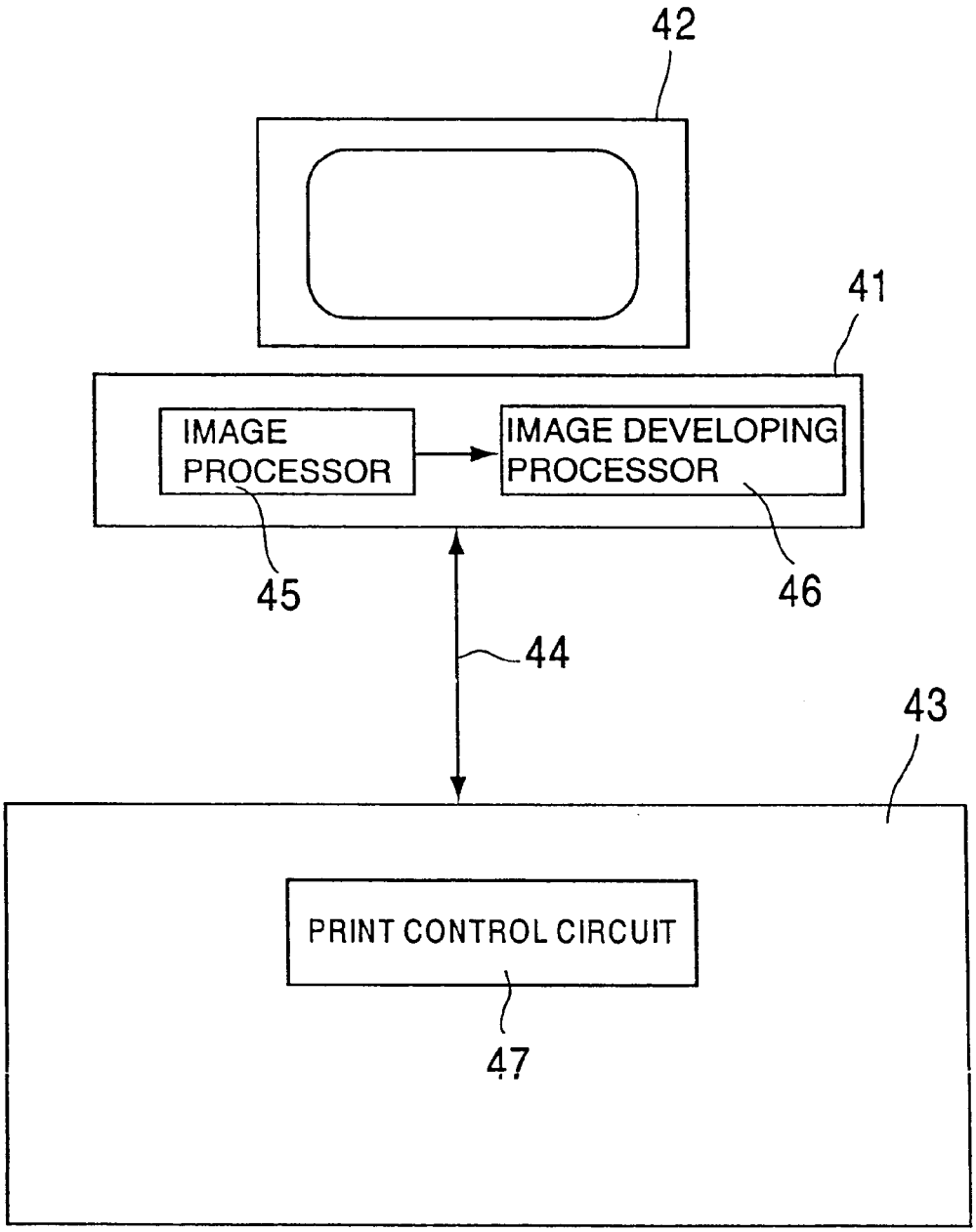
FIG. 8 is a block diagram schematically showing a printer system involved in the embodiment of this invention.

FIG. 8 is a schematic diagram showing the structure of a printer system in this embodiment. This printer system is in the structure with a personal computer (hereinafter, simply referred to as PC) equipped with a display 42 connected to a printer 43 by a two-way communication means 44. The PC 41 is provided with an image processor 45 as an image processing means and an image developing processor 46 as an image developing processing means. Further, the printer 43 is provided with a print control circuit 47 as a print control means.

As image data for printing by the printer 43, for example, face image data, character image data and other multi-valued image data are input from a scanner or a digital camera (not shown). In the PC 41, such image processes as color conversion, edge enhancement, etc. are applied to the input face image data and other multi-valued image data in the image processor 45. Further, character image data are converted from a desired font into bit-mapped data.

The multi-image data and the character image data converted into the bit-mapped data processed in the image processor 45 are subject to the image development in the image developing processor 46. That is, in the image developing processor 46, the input data are judged whether they are character image or multi-valued image. When the result of judgment is character image data, bit-mapped image data are sent to the print control circuit 47 of the printer 43 as image data to be printed.

Figure 9:
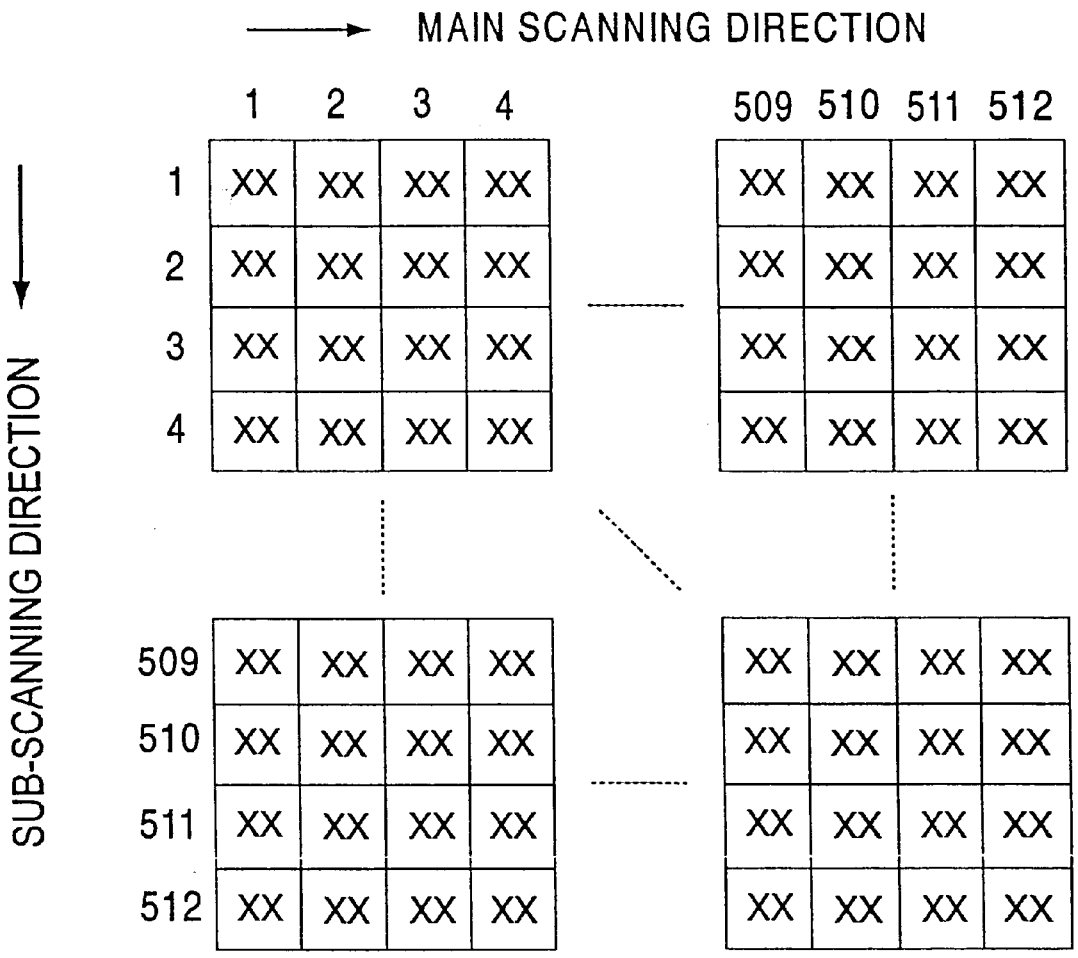
FIG. 9 is a schematic diagram showing the arrangement of pixels of image data involved in the embodiment of this invention.
Figure 10:
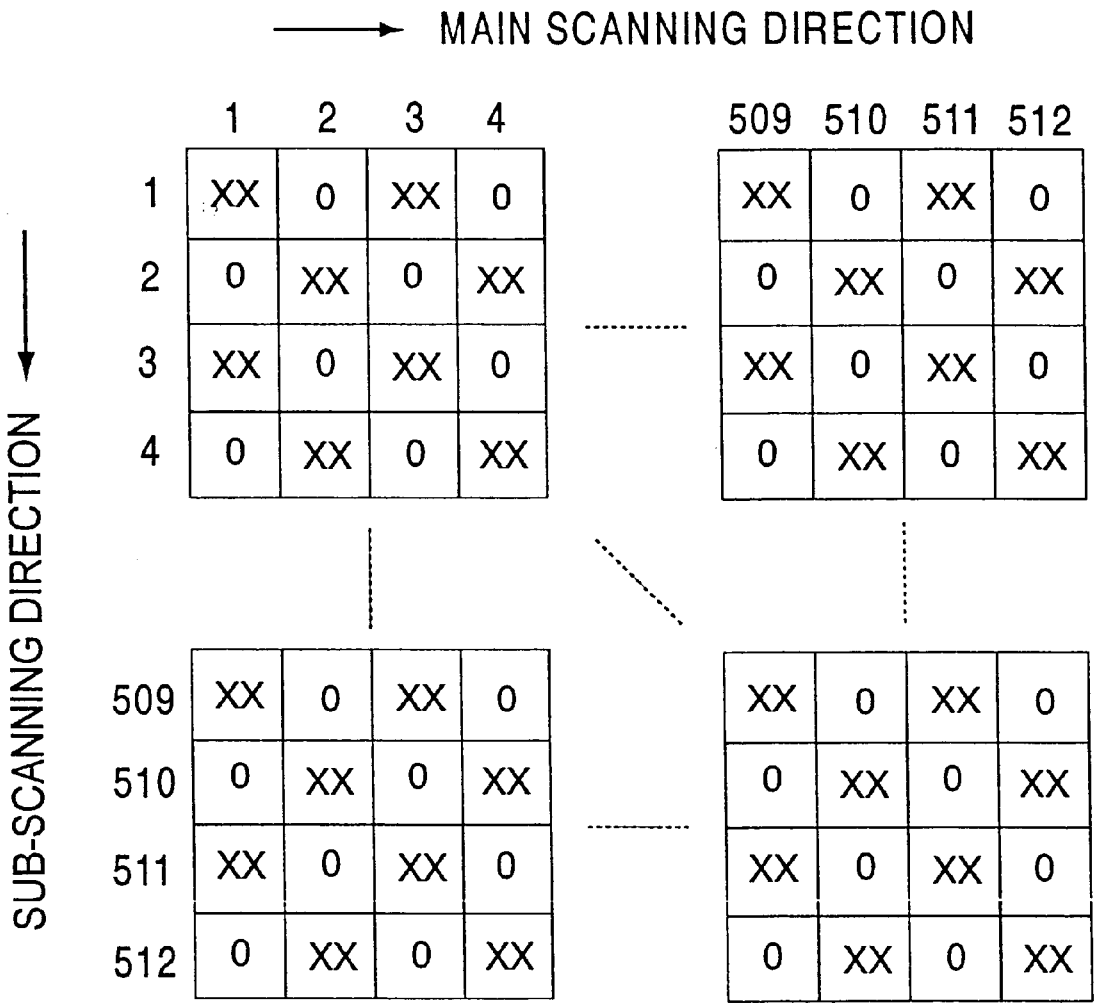
FIG. 10 is a schematic diagram showing the arrangement of pixels of image data involved in the embodiment of this invention.

On the other hand, when the result of judgment was multi-valued image data, for example, after arranging pixels as shown in FIG. 9 and FIG. 10, multi-valued image data are sent to the print control circuit 47 of the printer 43 as the image data to be printed. FIG. 9 shows the pixel arrangement of the image data sent to the image developing processor 46 from the image processor 45. The numerals in the figure are the number of lines of pixels in the main scanning direction and the sub-scanning direction. The pixels of one line in the sub-scanning direction (for example, Sub-Scanning Line No. 1 to Main Scanning Line No. 1-512) are printed by driving the thermal print head after they are developed into data for driving the thermal print head and then, transferred to a driving circuit in the thermal print head (not shown).

In the alternate driving, the odd numbered heating elements of the odd numbered lines in the sub-scanning direction and the even-numbered heating elements of the even-numbered lines in sub-scanning direction are alternately driven for each printing line by the thermal print head. Therefore, the image data that are not printed (the heating elements are not driven); that is, "O" data in this example are arranged in zigzags and pixel data that are printed according to the image data are arranged in the portion of not "O" data as shown in FIG. 10.

Thus, in the image developing processor 46, the image array shown in FIG. 9 is converted into the image array as shown in FIG. 10 and sent to the print control circuit 47 of the printer 43 as image data to be printed.

Further, the print control circuit 47 and the PC 41 are connected with a two-way communication means 44 like a SCSI (Small Computer System Interface) or a USB (Universal Serial Bus), and image data to be printed and a printing start signal are sent from the PC 41 to the print control circuit 47 of the printer 43. In the print control circuit 47 of the printer 43 receives image data from the PC 41 through the two-way communication means 44, converts the data into a thermal print head driving signal or controls the entire printing operation.

The pixel array for the alternate driving is arranged by the image developing processor 46 of the PC 41 as described above and the print control circuit 47 of the printer 43 is required only to convert the pixel array into the thermal print head driving signal and the circuit is not complicated. Therefore, the print control circuit 47 can be made more simple and cheaper.

Next, the printer 43 shown in FIG. 8 will be explained in detail.

FIG. 11 is a diagram schematically showing the structure of the printer 43. In FIG. 11, a thermal print head 22 that is a thermal printing means is provided on a platen roller 21. The thermal print head 22 is an edge type thermal print head as described above and is provided detachably on the platen roller 21 through the above-mentioned thermal transfer ink ribbon 11 and the intermediate transfer medium 6. The thermal transfer ink ribbon 11 is supplied between the platen roller 21 and the thermal print head 22 by a supply core 23 and taken up by a take-up core 24.

At the take-out side of the intermediate transfer medium 6 near the platen roller 21, a clamp roller 25 is provided to receive and convey the intermediate transfer medium 6. On the clamp roller 25, a clamp 26 is provided for clamping the intermediate transfer medium 6. At the take-out side of the clamp roller 25, a conveying roller 27 is provided for conveying the take-out intermediate transfer medium 6.

In front of the conveying roller 27, a heating roller 28 that is a transfer means and a facing roller 29 facing to the heating roller 28 are provided. The heating roller 28 puts the intermediate transfer medium 6 supplied by the conveying roller 27 over a printing medium 30 (not shown) that is separately supplied and presses them jointly with the facing roller 29, and transfers an image printed on the intermediate transfer medium 6 on the printing medium 30 by heating the intermediate transfer medium 6 while rotating them.

The intermediate transfer medium 6 is supplied between the platen roller 21 and the thermal print head 22 from the supply core 31 and then, supplied to the hear roller 29 via the clamp roller 25 and the conveying roller 27. After an image and the protector layer 9 on the intermediate transfer medium 6 are transferred on the printing medium 30, the intermediate transfer medium 6 is taken up by the take-up core (not shown) via a separation roller 32.

In such the structure, when a print start signal is supplied from the PC 41, the thermal transfer ink ribbon 11 is rolled up by the take-up core 24 to the print start position. Then, when the intermediate transfer medium 6 is clamped by both the clamp 26 and the clamp roller 25, the thermal print head 22, the thermal transfer ink ribbon 11 and the intermediate transfer medium 6 are pushed against the platen roller 21 under a desired pressure and the printing operation is started.

Figure 12A:
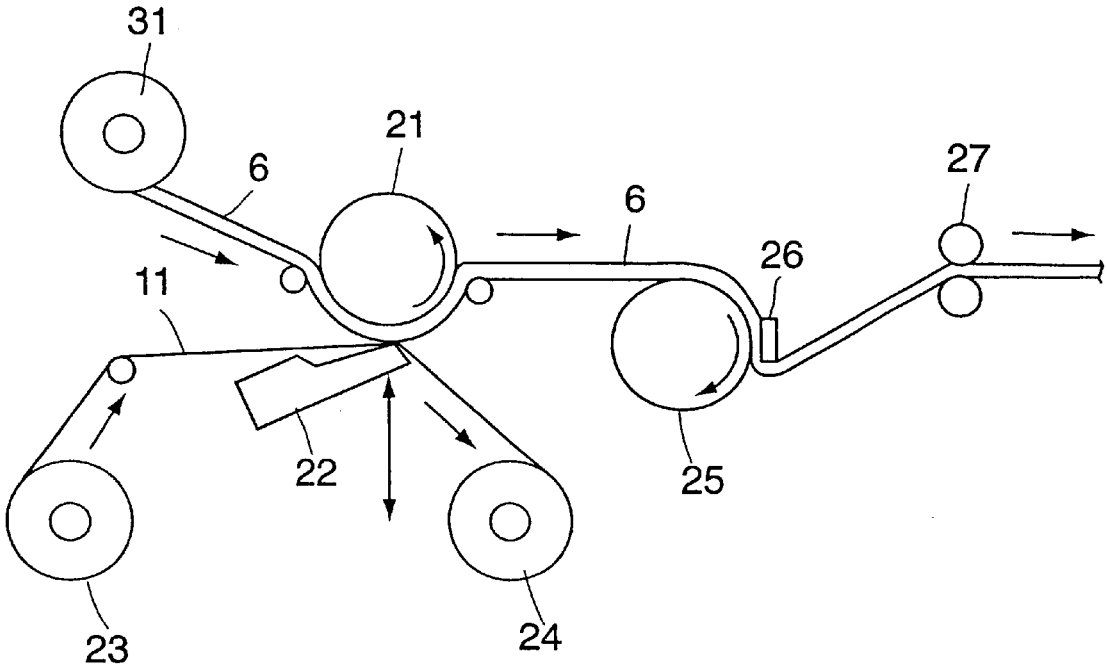
FIG. 12A and FIG. 12B are diagrams for explaining the operation of the printer shown in FIG. 11.

The thermal print head 22 is driven by the thermal print head driving signal corresponding to the image data sent from the print control circuit 47, the clamp roller 25 is rotated at a rotational speed corresponding to the printing speed while clamping the intermediate transfer medium by both the claim and clamp roller 25 as shown in FIG. 12A, and the printing operation is thus carried out. At this time, the platen roller 21 is not forced to rotate for the problem of positional accuracy.

When the first color printing is completed, the thermal print head 22 and the thermal transfer ink ribbon 11 are separated from the intermediate transfer medium 6. On the other hand, the supply core 31 and the clamp roller 25 are rotated in the direction opposite to that at the time of printing operation and the intermediate transfer medium 6 is rolled back to the supply core 31 side till the print starting position. Then, the printing operation is repeated again and the printing of an image in 3 colors is carried out.

When all of the 3 color printings are completed, the intermediate transfer medium 6 is rolled back to the supply core 31 side to the printing start position by the supply core 31 and he clamp roller 25, and the intermediate transfer medium 6 is released from the clamp 27.

Figure 12B:
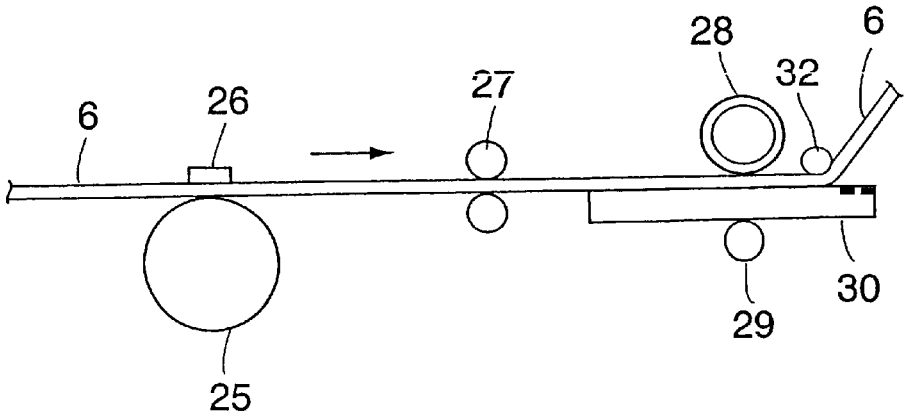

Next, the intermediate transfer medium 6 released from the clamp 26 is supplied to a heating roller 28 by the conveying roller 27 as shown in FIG. 12B. When the intermediate transfer medium 6 is supplied to the heating roller 28, another printing medium is supplied from a printing medium supply tray (not shown). Here, the leading edge of the image area of the intermediate transfer medium 6 is adapted to that of the printing medium 30 and the intermediate transfer medium 6 is press fit to the printing medium 30 by the heating roller 28 and the facing roller 29. Then, while heating the intermediate transfer medium 6 by rotating the heating roller 28, the receptor layer 10 and the protective layer 9 on the intermediate transfer medium 6 are transferred on the printing medium 30 and the printing medium 30 is discharged to the separation roller 32 side.

The separation roller 32 separates the substrate member 7 from the separable layer 8 of the intermediate transfer medium 6 and transfers the protective layer 9 and the receptor layer 10 on the printing medium 30. When the trailing edge of the printing medium 30 passed the heating roller 28, the transfer operation of the intermediate transfer medium 6 is completed. When the transfer operation of the intermediate transfer medium 6 is completed, the intermediate transfer medium 6 is rolled back by the supply core 31 up to the print start position of the intermediate transfer medium 6, and the printing operation similar to the above is started again.

Next, the action and effect of the thermal transfer ink ribbon 11, the platen roller 21 and the press fitting force of the thermal print head 22 with the platen roller 21 in this embodiment will be explained.

Figure 13A:
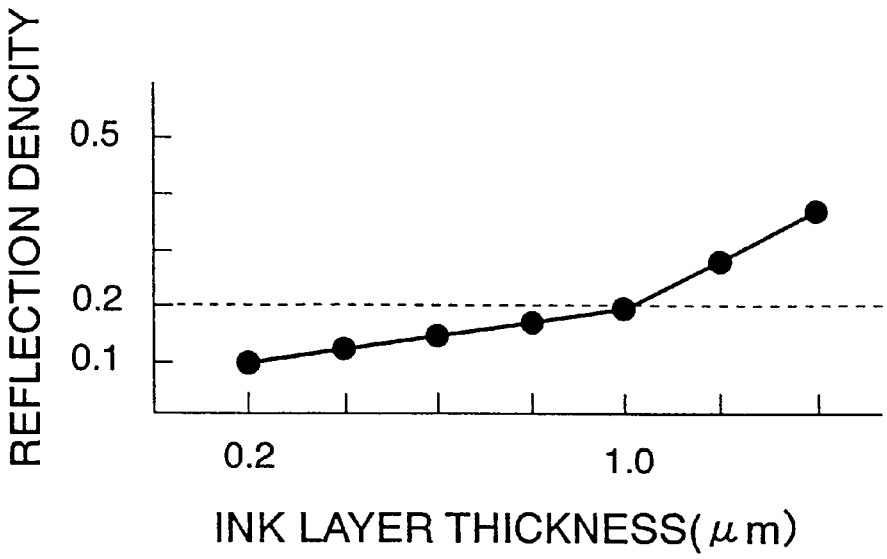
FIG. 13A and FIG. 13B are graphs showing the characteristic of reflection density against the ink layer thickness.
Figure 13B:
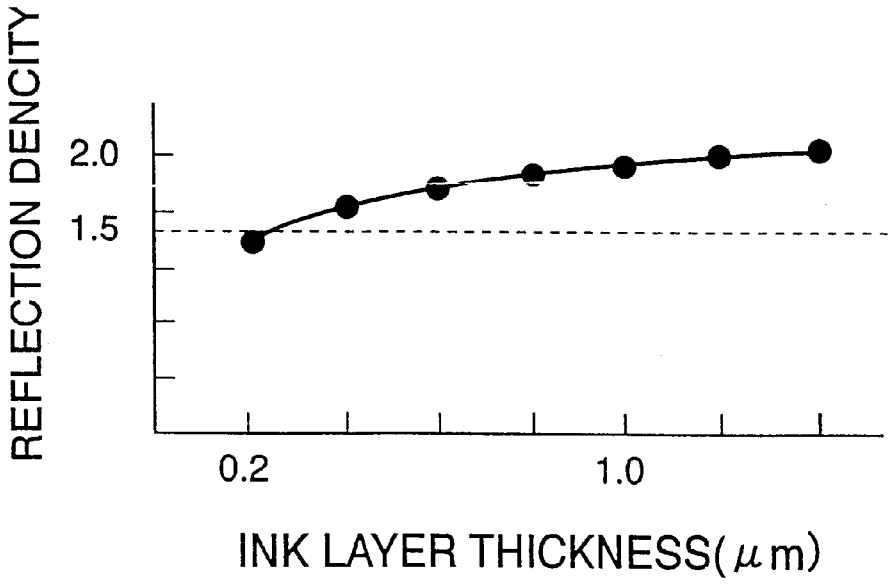

FIG. 13A and FIG. 13B show representative reflection densities of a multi-valued image when the thickness of the black ink layer was changed. FIG. 13A shows the minimum density that can be reproduced while FIG. 13B shows the maximum density. The densities shown in FIG. 13A and FIG. 13B are mean densities by printing gradation patterns by the printer 43 and the minimum and maximum densities at 10 points were measured using a Macbeth densitometer. Although a required minimum density varies depending upon images, a desirable density is below 0.2 because the purpose of this embodiment is mainly for printing face images. In FIG. 13A, the thickness of the ink layer for the reflection density below 0.2 is 1.0 $\mu$m or below.

Further, although a required maximum density varies depending upon images, 1.5 or above is desirable for the purpose of printing face images. According to FIG. 13B, the thickness of the ink layer for the maximum density 1.5 or above is 0.4 $\mu$m or above. That is, it is seen that for the minimum density 0.2 or below and the maximum density 1.5 or above, the thickness of the ink layer is required to be 0.4–1.0 $\mu$m. In this embodiment, all of the ink layers are set at 1 $\mu$m or below and therefore, even when any ink layer is used, it is possible not only to print multi-valued images but also to provide even binary images in sufficient density and achieve high quality images.

Figure 14:
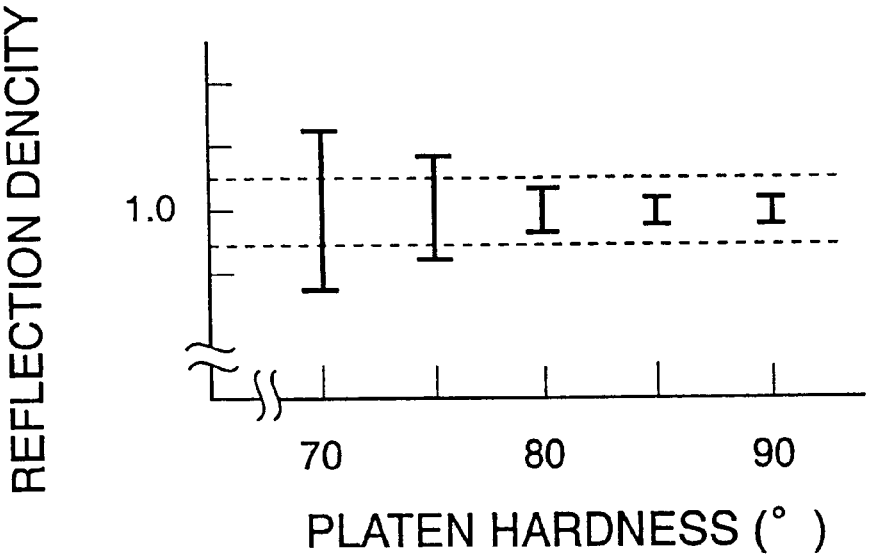
FIG. 14 is a graph showing the characteristic of reflection density against the platen hardness.

FIG. 14 shows dispersion in reflection density of a black ink of multi-valued image when a rubber hardness of the platen 21 was changed. The distances of two horizontal lines (the lengths of the vertical lines) in FIG. 14 indicate standard deviations. Shown in FIG. 14 are standard deviations when halftone solid patterns of reflection density 1.0 were printed and densities at 10 points were measured using a Macbeth densitometer.

When printing face images, it is desirable that the reproducibility of the halftone areas is especially satisfactory and the range of dispersion is desirable at ±1% or below. When the rubber hardness of the platen becomes 80° or above as in FIG. 14, the range of dispersion (the standard deviation) can be made to below ±1%. In other words, it is seen that the rubber hardness of the platen 21 is required to be above 80°.

Figure 15:
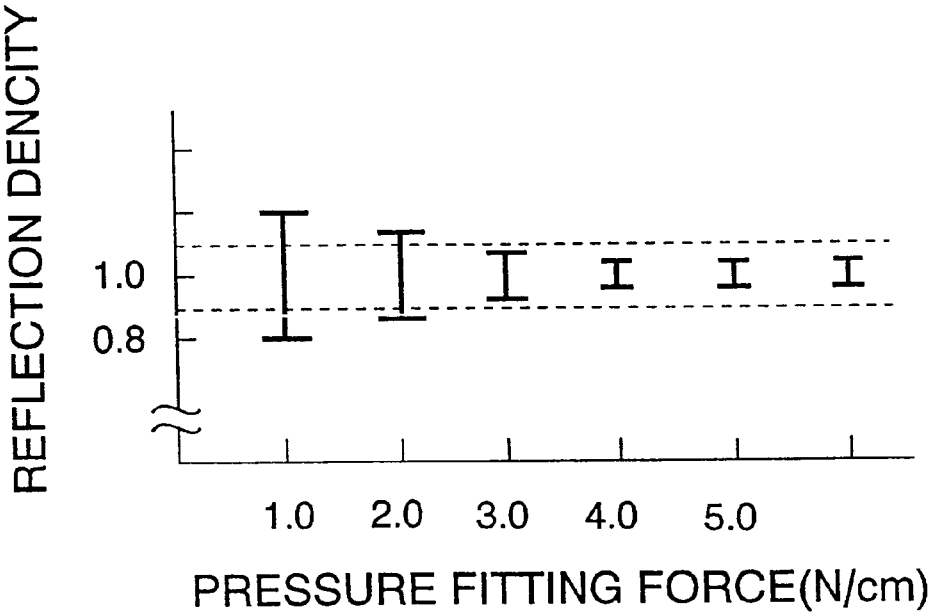
FIG. 15 is a graph showing the characteristic of reflection density against the compression force of the thermal print head to the platen.

FIG. 15 shows the dispersion of reflection density of multi-valued images when the press contacting force between the thermal print head 22 and the platen 21 was changed. The two horizontal line distances (the lengths of the vertical lines) in FIG. 15 indicate standard deviations. What are shown in FIG. 15 are standard deviations when halftone solid patterns of reflection density 1.0 were printed and densities at 10 points were measured using a Macbeth densitometer. Dispersion of reflection density can be lowered to ±1% or below when the pressure contact force is 3.0 N/cm or above.

As described above, according to this invention, it is possible to provide a thermal transfer printing method, a thermal transfer ink ribbon and a printer system capable of printing multi-valued images such as highly gradient color images, binary images like character images and fluorescent images preventing forgery/alteration.

What is claimed is:

1. A thermal transfer printing method in a thermal transfer printing apparatus including:

a thermal transfer ink ribbon having a 0.4–1 $\mu$m thick color thermofusible ink layers formed on a film-shaped substrate member;

an intermediate transfer medium having a receptor layer on which ink in the multiple thermofusible color ink layers are transferred from the thermal transfer ink ribbon formed on a film-shaped substrate member;

a thermal print head having multiple heating elements arranged in a line so as to form one pixel using at least two heating elements; and a platen roller formed by an elastic material having a rubber hardness more than 80° contacting the thermal print head, the thermal transfer ink ribbon and the intermediate transfer medium in the overlapped state, the thermal transfer printing method comprising:

forming an image on the receptor layer of the intermediate transfer medium by selectively applying and driving the heating elements of the thermal print head according to image data so as to thermally transfer inks of thermofusible ink layers from the thermal transfer ink ribbon on the intermediate transfer medium; and transferring the receptor layer of the intermediate transfer medium having the formed image on a printing medium under pressure and heat.

2. The thermal transfer printing method according to claim 1, wherein odd-numbered heating elements and even-numbered heating elements of the thermal print head are powered and driven alternately for each printing line when printing multi-valued images and odd-numbered pixels and even-numbered pixels are formed alternately for each printing line.

3. The thermal transfer printing method according to claim 1, wherein pixels are formed in the direction that is in parallel with the heating element line direction of the thermal print head when printing binary images.

4. The thermal transfer printing method according to claim 1, wherein the multi-colored thermofusible ink layers of the thermal transfer ink ribbon are formed from coloring agents and binder resin as main components.

5. The thermal transfer printing method according to claim 1, wherein a press contacting force of the thermal print head and the platen roller is 3.0 N/cm or above.

6. The thermal transfer printing method according to claim 1, wherein the multi-colored thermofusible ink layers of the thermal transfer ink ribbon comprises a cyan ink, a magenta ink, an yellow ink, a black ink and a colorless or a light-colored ultraviolet rays exciting fluorescent ink.

7. The thermal transfer printing method according to claim 1, wherein the thermal transfer ink ribbon for printing multi-valued images by the thermal print head forms a thermofusible cyan, magent, yellow, black and colorless or light color ultraviolet rays exciting fluorescent ink layers on one side of a long film-shaped support member.

8. The thermal transfer printing method according to claim 7, wherein the thickness of the ink layers of the thermal transfer ink ribbon is 0.4–1 $\mu$m.

9. A printer system comprising:

a printer including:

a thermal transfer ink ribbon having a 0.4–1 $\mu$m thick color thermofusible ink layers formed on a film-shaped substrate member;

an intermediate transfer medium having a receptor layer on which inks in the multiple thermofusible color ink layers are transferred from the thermal transfer ink ribbon formed on a film-shaped substrate member;

a thermal print head having multiple heating elements arranged in a line so as to form one pixel using at least two heating elements; and a platen roller formed by an elastic material having a rubber hardness more than 80° contacting the thermal print head, the thermal transfer ink ribbon and the intermediate transfer medium in the overlapped state, and a print controller to control the image printing by selectively powering and driving the heating elements of the thermal print head according to image data, form an image on the receptor layer of the intermediate transfer medium by thermally transferring inks of the thermofusible ink layers of the thermal transfer ink ribbon on the receptor layer of the intermediate transfer medium, and transfer the receptor layer of the intermediate transfer medium with the image formed thereon; and a computer connected to the printer via a two-way communication means and send image data to be printed to the print controller of the printer.

10. The printer system according to claim 9, wherein the computer further comprising:

an image developing processor to develop image data to be printed by applying power and driving odd-numbered heating elements and even-numbered heating elements of the thermal print head alternately for each printing line so as to form odd-numbered pixels and even-numbered pixels alternately for each printing line and send the developed image data to the print controller of the printer when printing multi-valued images in the printer.

11. The printer system according to claim 9, wherein the computer further comprising:

an image developing processor to develop image data to be printed so as to form pixels in the direction parallel to the parallel direction of the heating elements of the thermal print head and send the developed image data to the print controller of the printer.

12. The printer system according to claim 9, wherein a pressure contacting force of the thermal print head and the platen roller is 3.0 N/cm or above.

13. The printer system according to claim 9, wherein multi-colored thermofusible ink layers of the thermal transfer ink ribbon comprises a cyan ink, a magenta ink, an yellow ink, a black ink and a colorless or light-colored ultraviolet rays exciting fluorescent ink.

14. The printer system according to claim 9, wherein a thermal transfer ink ribbon for printing multi-valued images by the thermal print head comprises a thermofusible cyan ink layer, a magent ink layer, an yellow ink layer, a black ink layer and a colorless or a light-colored ultraviolet rays exciting fluorescent ink layer formed on one side of a long film-shaped support member.

15. The printer system according to claim 14, wherein a thickness of the ink layers of the thermal transfer ink ribbon is 0.4–1 $\mu$m.

* * * * *